United States Patent [19]

Ponza

[11] Patent Number: 4,699,377

[45] Date of Patent: Oct. 13, 1987

[54] BATTING PRACTICE DEVICE

[76] Inventor: Larry Ponza, 910 Columbia St., Santa Cruz, Calif. 95060

[21] Appl. No.: 721,158

[22] Filed: Apr. 8, 1985

[51] Int. Cl.[4] ..... A63B 69/40

[52] U.S. Cl. ..... 273/26 E; 273/58 C

[58] Field of Search ..... 273/26 R, 184 B, 185 D, 273/29 A, 200 B, 184 R, 197 R, 196, 26 R

[56] References Cited

U.S. PATENT DOCUMENTS

| | | | |
|---|---|---|---|
| 2,818,255 | 12/1957 | Ponza | 273/26 E |
| 3,341,200 | 9/1967 | Brandley | 273/26 E |
| 3,762,705 | 10/1973 | Gonzalez | 273/26 R |
| 3,794,320 | 2/1974 | Salmont | 273/26 E |
| 3,897,057 | 7/1975 | Pennington | 273/26 R |
| 4,105,203 | 8/1978 | Cho | 273/29 A |
| 4,175,744 | 11/1979 | Llewellyn | 273/26 E |

FOREIGN PATENT DOCUMENTS

| | | | |
|---|---|---|---|
| 704981 | 3/1931 | France | 273/29 A |

*Primary Examiner*—Richard C. Pinkham
*Assistant Examiner*—T. Brown
*Attorney, Agent, or Firm*—Flehr, Hohbach, Test, Albritton & Herbert

[57] ABSTRACT

A batting practice device employs a rotatable arm to which a practice ball is mounted. The arm is adapted to be set at an inclination relative to ground level to improve batting skill. Simple height adjustment and braking are provided.

13 Claims, 17 Drawing Figures

BATTING PRACTICE DEVICE

DESCRIPTION

1. Technical Field

This invention relates to a batting practice device and in particular to a batting practice device which is mechanically presented to a batter thereby obviating the necessity for the employment of another individual as a pitcher to the batter.

2. Background Art

Batting practice devices have been described in prior art patents and publications, and have been used extensively. For example, U.S. Pat. No. 2,818,255, which was issued to the same inventor, describes a batting practice device of the type disclosed and claimed in the present application. However, there has been a change recently in the theory of approaching the batting practice device, which enables the batter to improve his batting proficiency extensively.

Prior theories of batting coaches have emphasized the desirability of a level horizontal swing by a batter at the point of contact of the bat with the ball. Recently batting coach experts have advised that a batter should swing his bat directly down from the shoulder to the ball, instead of swinging level or horizontally as has been the practice in the past. This downward swing is believed to result in better accuracy, increased impact force, with a resultant improvement in batting skill.

Prior art batting practice devices generally have a ball mounted to an arm that is disposed in a substantially horizontal plane. If the batter swings down at the ball, then the resultant movement of the horizontally disposed arm will be overly vibratory and will not provide a valid indication of the batter's skill. Therefore, it would be desirable to change the mechanical arrangement of the batting practice device to improve his skill.

SUMMARY OF THE INVENTION

An object of this invention is to provide an improved batting practice device which enables a batter to practice batting of a ball so as to improve his skill.

Another object of the invention is to provide a simple means for adjusting the position and angular orientation of the practice ball and arm, so that the batter can improve his skill rapidly and efficiently.

In accordance with this invention, a batting practice device incorporates means for selection of the angular orientation of the arm to which the ball is mounted relative to the ground or to the horizontal plane. In addition, means is provided for easy and rapid adjustment of the height of the arm over a broad range of height settings, and also to provide rapid and simple means for presenting the ball to either left or right handed batters. Furthermore, a repositioning means and a resistive braking action are employed so that the alignment of the arm to which the ball is mounted is always true. Other novel modifications in addition to the above-mentioned features are realized in accordance with this invention.

BRIEF DESCRIPTION OF THE DRAWINGS

The invention will be described with reference to the drawings in which.

Similar numerals refer to similar elements throughout the drawings.

DESCRIPTION OF THE PREFERRED EMBODIMENT

Figure 1:
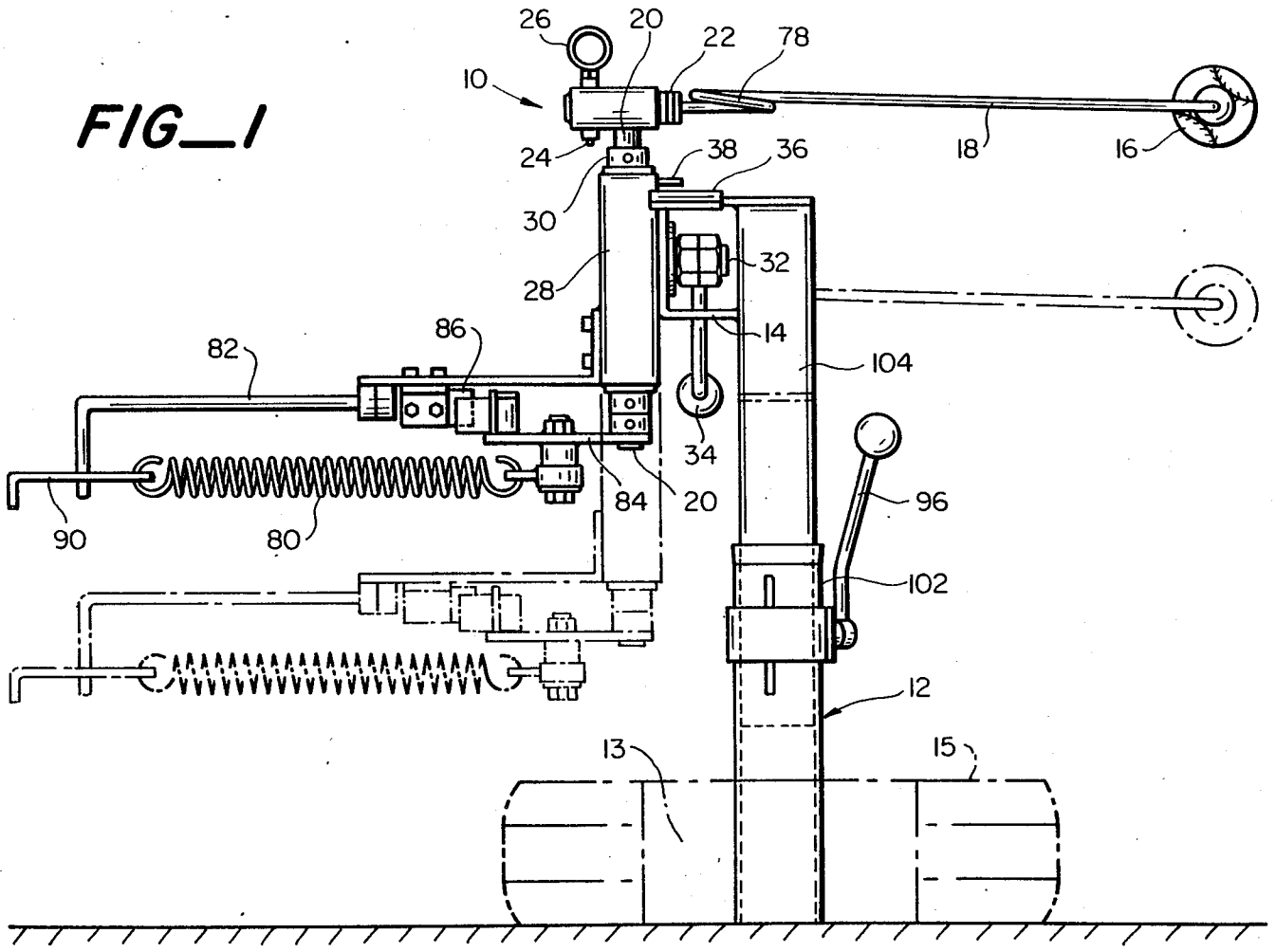
FIG. 1 is a schematic side view of the batting practice device of this invention.

With reference to the FIGURES, and particularly to FIG. 1, a batting practice device includes a rotatable assembly 10 that is mounted to a fixed main post 12 by means of a bracket or clamp 14. The post 12 is securely seated in a cement body 13 form within a rubber tire 15, by way of example. A target ball 16 is rotatably attached to an arm 18, which is coupled to a rotary shaft 20 of the rotatable assembly. The arm 18 is made of spring steel and is tightly fit into a steel sleeve 22. The spring steel arm 18 is swaged into place by means of a 100 ton per square inch press operation, by way of example. The arm 18 is formed with one or more loops 78 which serve to dissipate shock forces.

Figure 9:
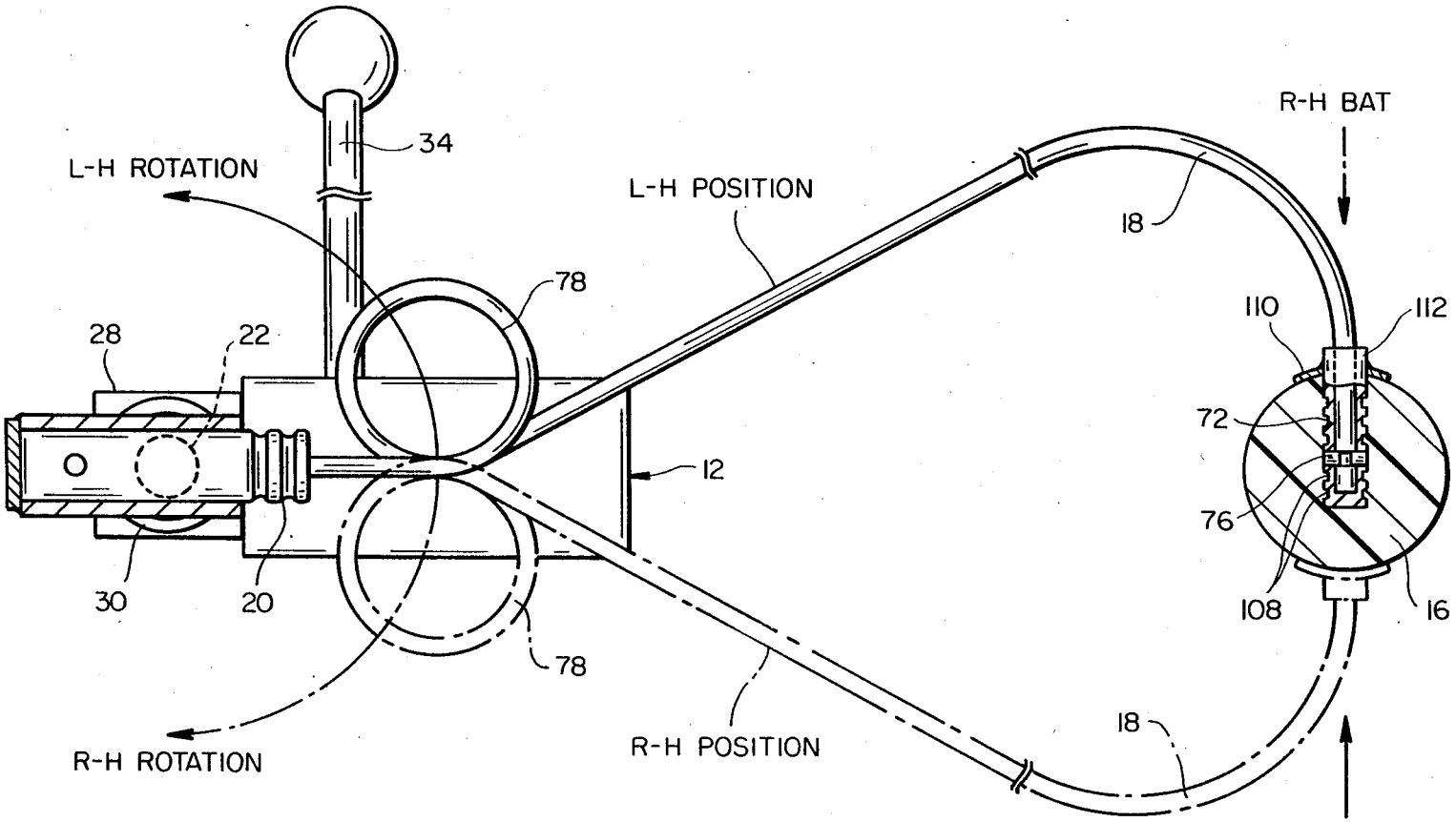
FIG. 9 is a sectional view taken through lines 9—9 of FIG. 7.

The steel sleeve 22 has an aperture of about one-quarter inch diameter, for example, in which a tempered steel lock pin 24 and a top holding ring 26 are positioned. The lock pin 24 is easily removable and allows swinging the arm 18 about 180° around to a position that would accommodate either a right hand or a left hand batter, as illustrated in FIG. 9.

The rotatable assembly 10 includes a shaft post 28 which encompasses the rotary shaft 20. A collar 30 is located around the rotary shaft 20 and fits on top of the shaft post 28. The arm 18 and ball 16 are rotatable about a pivot 32, which is locked by a securing lever 34.

Figure 4:
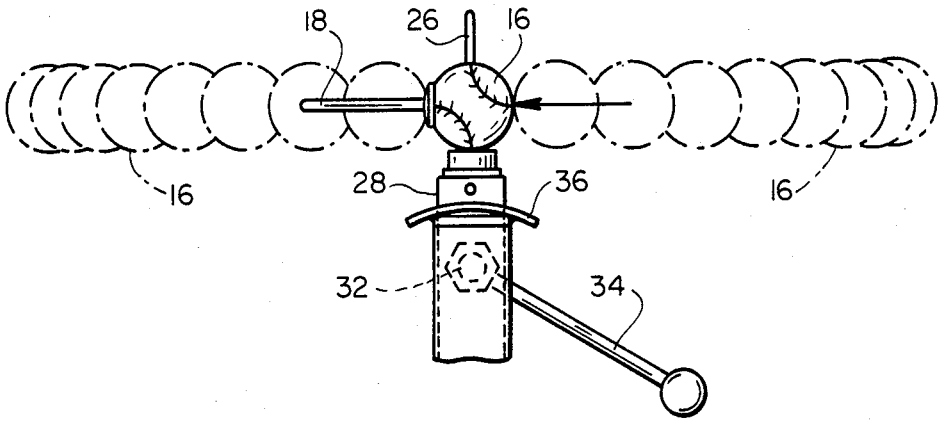
FIG. 4 is a representational view indicating the path of the ball when the arm is disposed horizontally.
Figure 5:
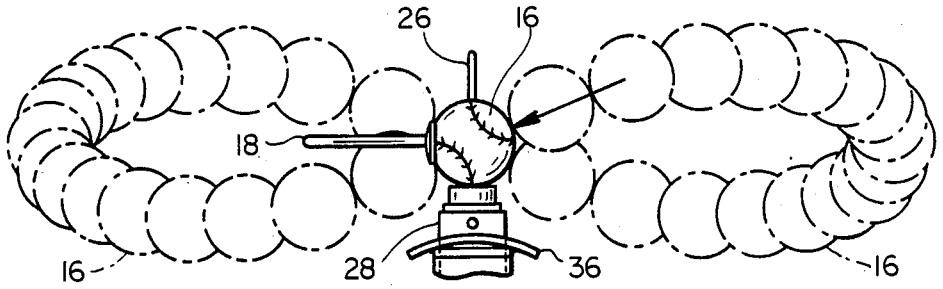
FIG. 5 is a representational view of the path of the ball when the ball is struck improperly.

In prior art approaches, the arm 18 is set in a substantially horizontal plane, and the arm 18 and ball 16 are rotated horizontally, as illustrated in FIGS. 4 and 5. If the batter makes a level swing at the ball, so that the ball is optimally impacted, the arm and ball are caused to rotate in a horizontal plane, as shown in FIG. 4. If the batter swings so that the ball is tapped or otherwise hit improperly, the ball and arm will vibrate during rotation as shown in FIG. 5.

In accordance with this invention, the arm 18 is set to an angular orientation, somewhere between 0° and 15° relative to ground level, by way of example. To accomplish the desired setting, the securing lever 34 is loosened to release pressure of the clamp 14 and to allow rotation of shaft post 28 and associated arm 18 about the pivot 32. A calibration plate 36 provides an indication of the angular tilt of the assembly relative to the horizontal plane or ground. When the desired tilt angle is attained, the securing lever 34 is moved back to the locking position. During the setting of the arm to its desired angular orientation, a limiter pin 38 and limit stops 40 formed in the indicator plate 36 are provided to define the limits of the angular setting of the arm.

During batting practice, the batter addresses the ball and swings downwardly taking the bat head directly to the ball, in accordance with the latest approach to a proper batting swing. When the batter swings down at the ball which is stationary on the inclined arm, the arm 18 will rotate about the shaft 20 for a number of revolutions depending upon the impact force of the bat against the ball. Another significant factor that affects the rotary travel of the arm and ball is whether the bat has contacted the ball squarely, or only topped or undercut the ball. If not squarely hit, the arm and ball will experience a vibratory motion as they rotate around the shaft, and the number of revolutions will be reduced. A "clean" hit will result in a relatively smooth orbital path of the arm and ball around the shaft and will realize more rotations, thereby visually indicating to the batter that his batting swing is proper.

Figure 6:
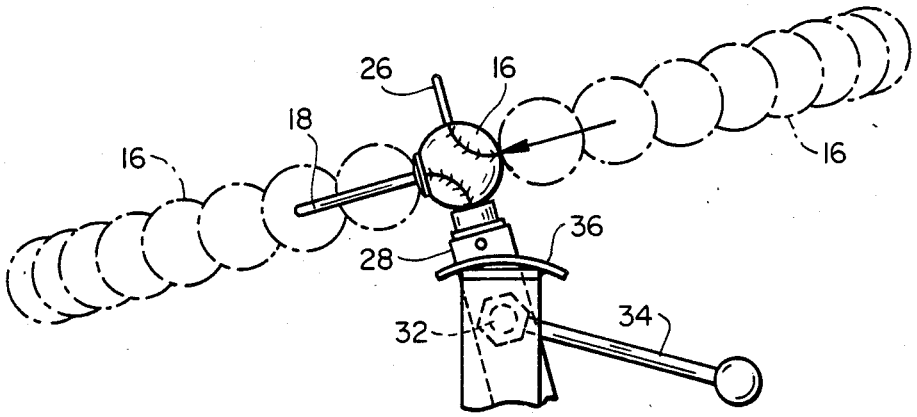
FIG. 6 is a representational view showing the path of the ball when the arm is disposed at a predetermined angle, in accordance with this invention.

Upon impact, the ball and arm rotate in an angular plane as shown in FIG. 6. If the ball is hit squarely in the downward swing, it has been observed that the number of revolutions of the arm and ball is greater than that experienced with a horizontal swing, for substantially the same impact force. Also, if hit properly, the ball rotates smoothly in its orbital path with minimal vibratory motion. Thus a visual indication is provided to the batter whether the ball has been properly hit, by noting the smoothness of the path of ball and arm rotation, and the number of revolutions made around the shaft post.

Figure 7:
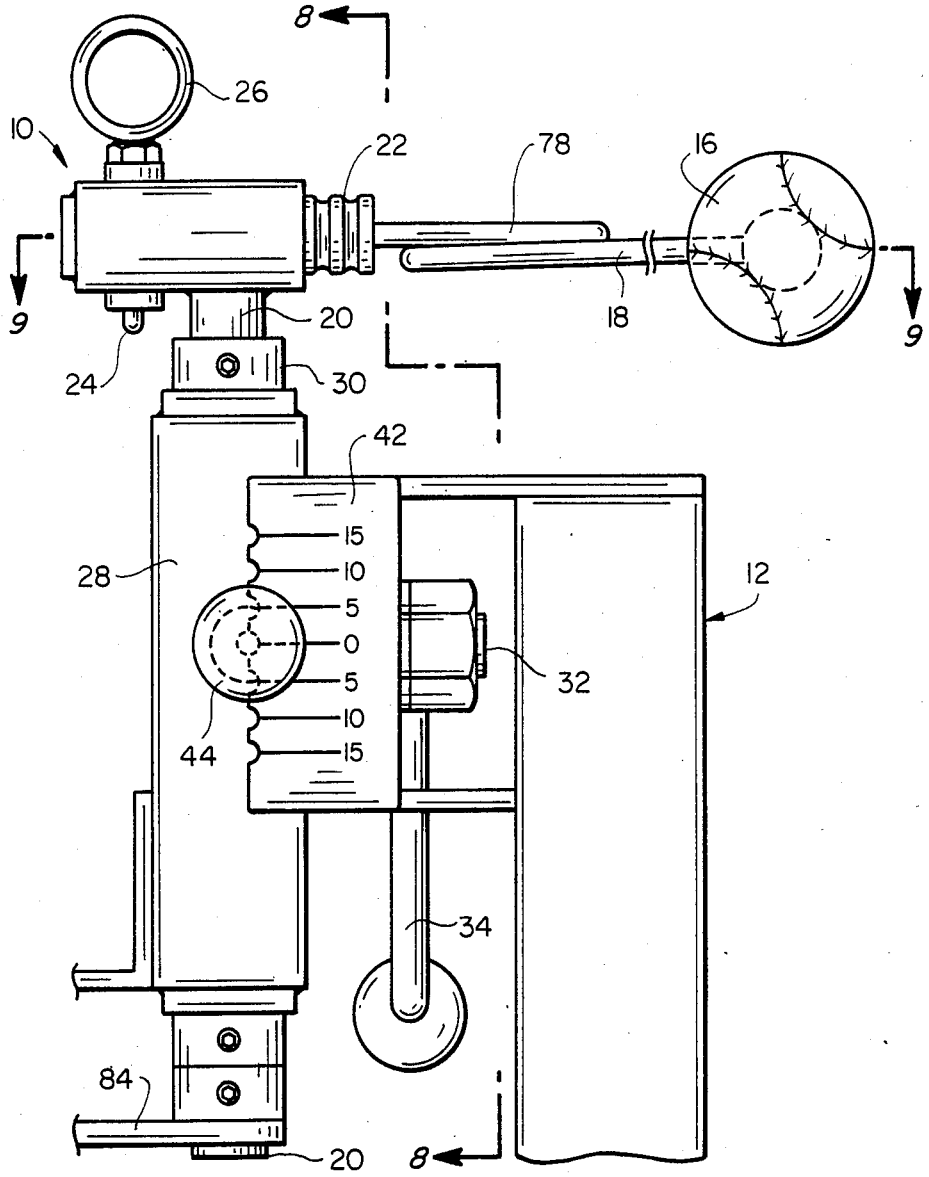
FIG. 7 is a top schematic view of the angular adjustment means of the present invention.
Figure 8:
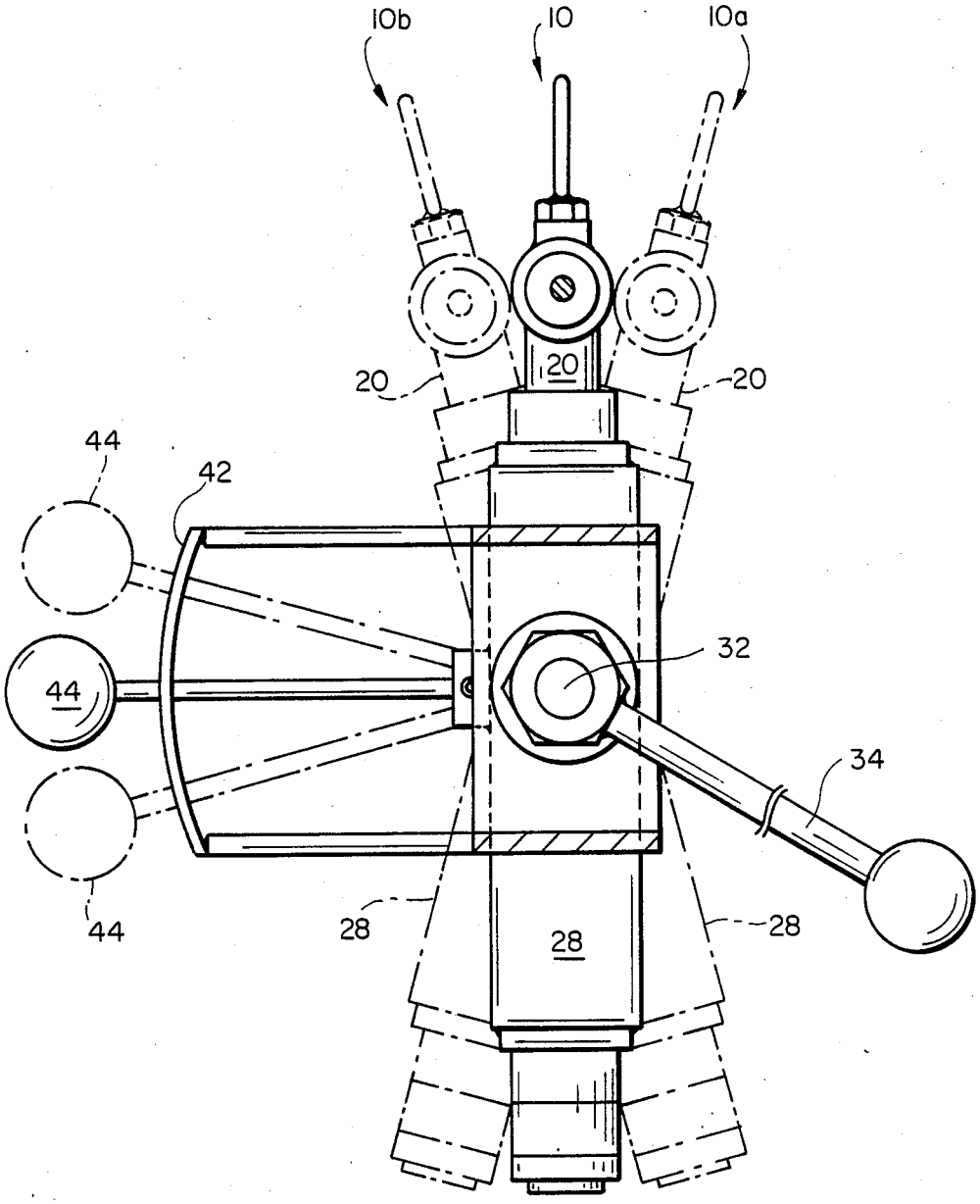
FIG. 8 is a sectional view taken through lines 8—8 of FIG. 7.

FIGS. 7 and 8 depict an alternate arrangement for setting the tilting angle of the arm 18. A grooved indicator plate 42 has groove positions from zero to 15 in each direction, which serve to seat a spring lever 44 that is coupled to the pivot 32 in a desired groove corresponding to the angle at which the arm is set relative to ground level. This outrigger type design affords precise settings at five degree increments.

Figure 10:
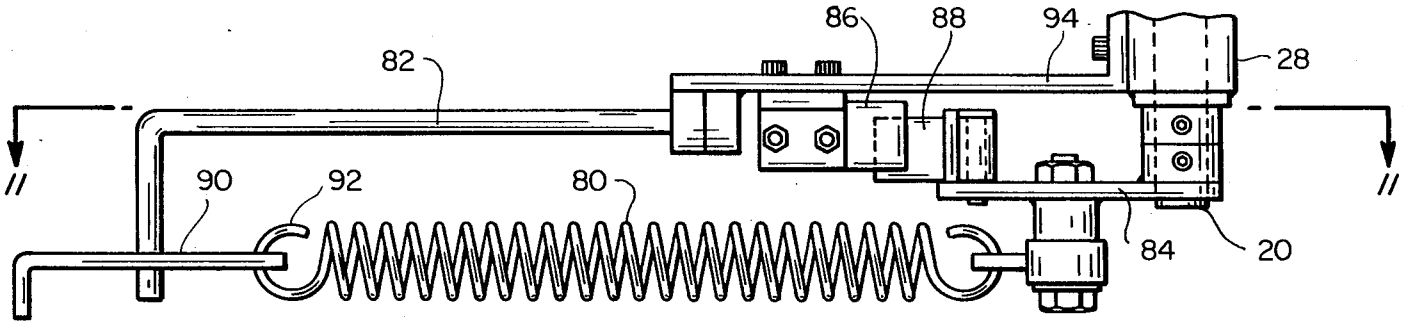
FIG. 10 is a side view of the resistive braking assembly and alignment means as employed in this invention.
Figure 11:
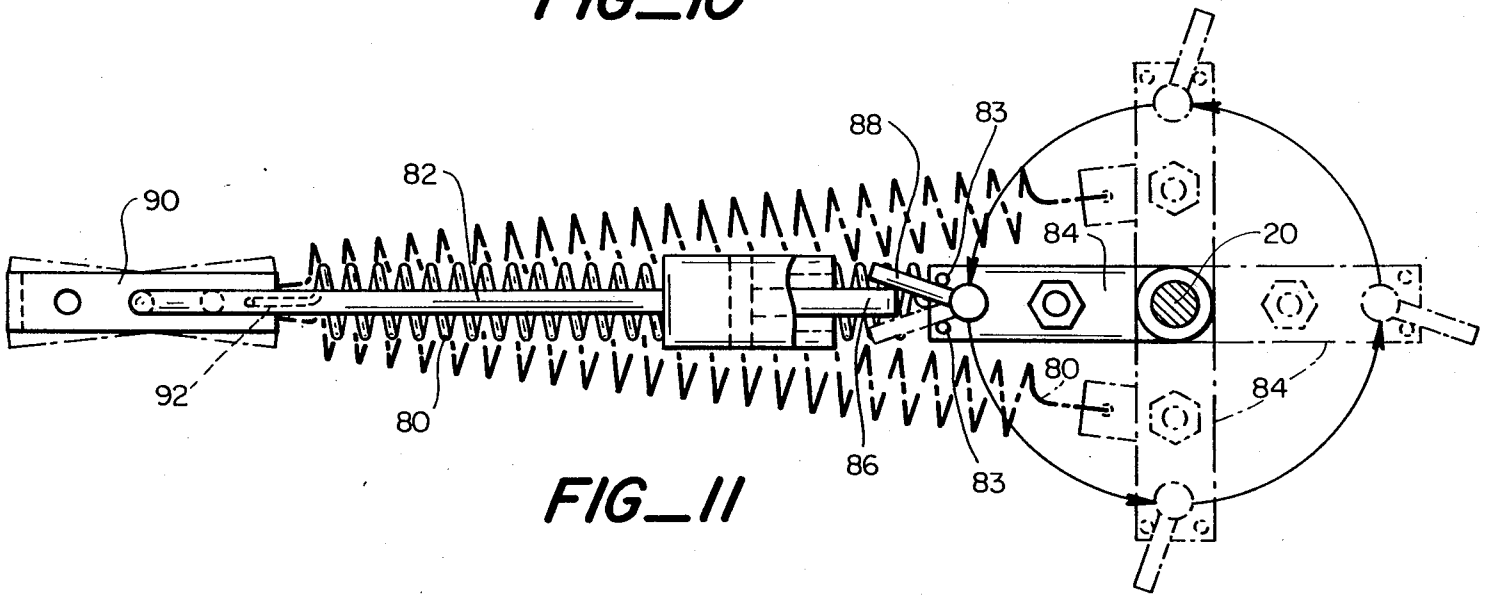
FIG. 11 is a side view illustrating the action of the resistive braking and true alignment means.
Figure 12:
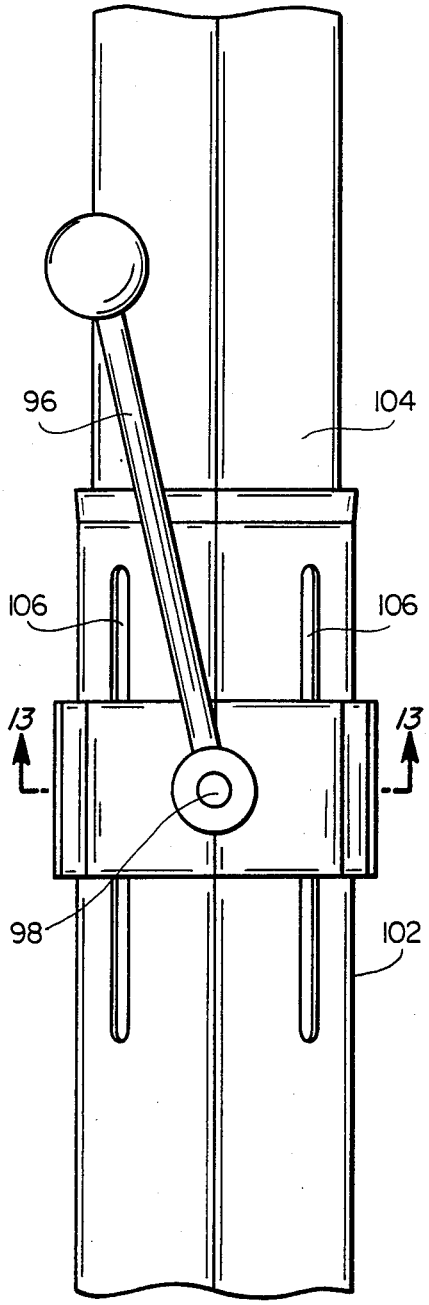
FIG. 12 is a side view depicting the height adjustment means.
Figure 13:
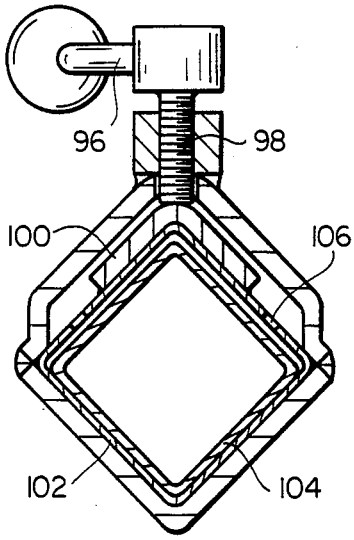
FIG. 13 is a sectional view taken through lines 13—13 of FIG. 12.
Figure 14:
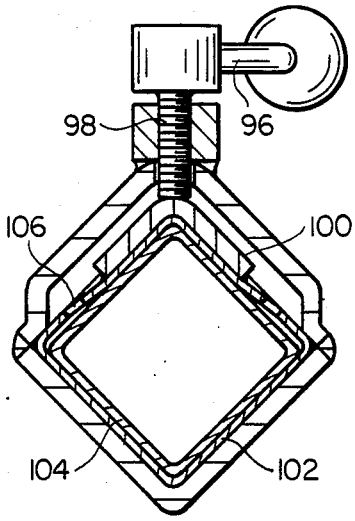
FIG. 14 is a detailed sectional view of the locking device for height adjustment.

With reference to FIGS. 10 and 11, a braking assembly and a repositioning and alignment means are provided to restore the ball and arm to a position of true alignment relative to the batter after each phase, consisting of the striking of the ball and the setting down of the arm and ball after a number of rotations. To this end, a flexible snubber brake 86 and a swivel stop bar 88 cooperate to provide a braking action to the rotating assembly 10. At the end of each revolution of the arm, which is designated as the home or rest position, the swivel bar 88, which is mounted on a crank plate 84, strikes the snubber brake to generate an impedance to the crank motion, thereby effectively braking the arm and the rotation of the crank. By virtue of this brake assembly, the settling time of the arm is reduced to about three seconds. In this way, the batter is able to swing at the ball at intervals of about every six seconds, which realizes a desired sustained batting practice procedure.

As depicted in FIG. 11, the swivel stop bar 88 remains in an offset position, limited by stop pins 83, either to one side or the other of the snubber brake, which is located in a neutral central position. The arm 18 always assumes a true alignment with the spring tension provided by a torsion spring 80. The swivel bar, in combination with the snubber brake, effectively dampens the oscillation of the arm and ball until they come to rest in the true alignment position.

The tension of the torsion spring 80 is adjustable by engaging the end of a hook bar 82 with one of the apertures of a grip plate 90. The hook bar also engages a hooked portion 92 of the spring. The hook bar 82 is rigidly coupled to the crank plate assembly and to a bracket 94 which is fastened to the rotatable shaft post 28.

With reference to FIGS. 1, 12, 13 and 14, a telescopic height adjustment structure includes a shaped outer tubing 102 and an inner slidable square shaped tubing 104. Upon release or loosening of a rotatable lever arm 96, the inner tubing 104 may be raised or lowered to a desired height. The inner tubing is coupled to the arm and ball assembly through the bracket 14 and shaft post 28, thereby providing for height adjustment of the arm.

In accordance with a feature of this invention, the rotatable lever 96 is coupled to a threaded element or set screw 98 which bears against an angular buffer member 100. The member 100 is frictionally seated against a corner of the inner tubing 104. Slots 106 are provided in the sides of the outer tubing to dissipate forces applied when the lever arm 96 is tightened by rotation about the set screw, which forces the screw against the buffer member. By this means, the frictional pressure area between the outer and inner tubings is greatly increased to secure the adjustment structure at a desired height setting, and the applied forces are dissipated over a larger area. Also, friction deformation marks that would normally appear on the tubings are effectively eliminated.

Figure 15:
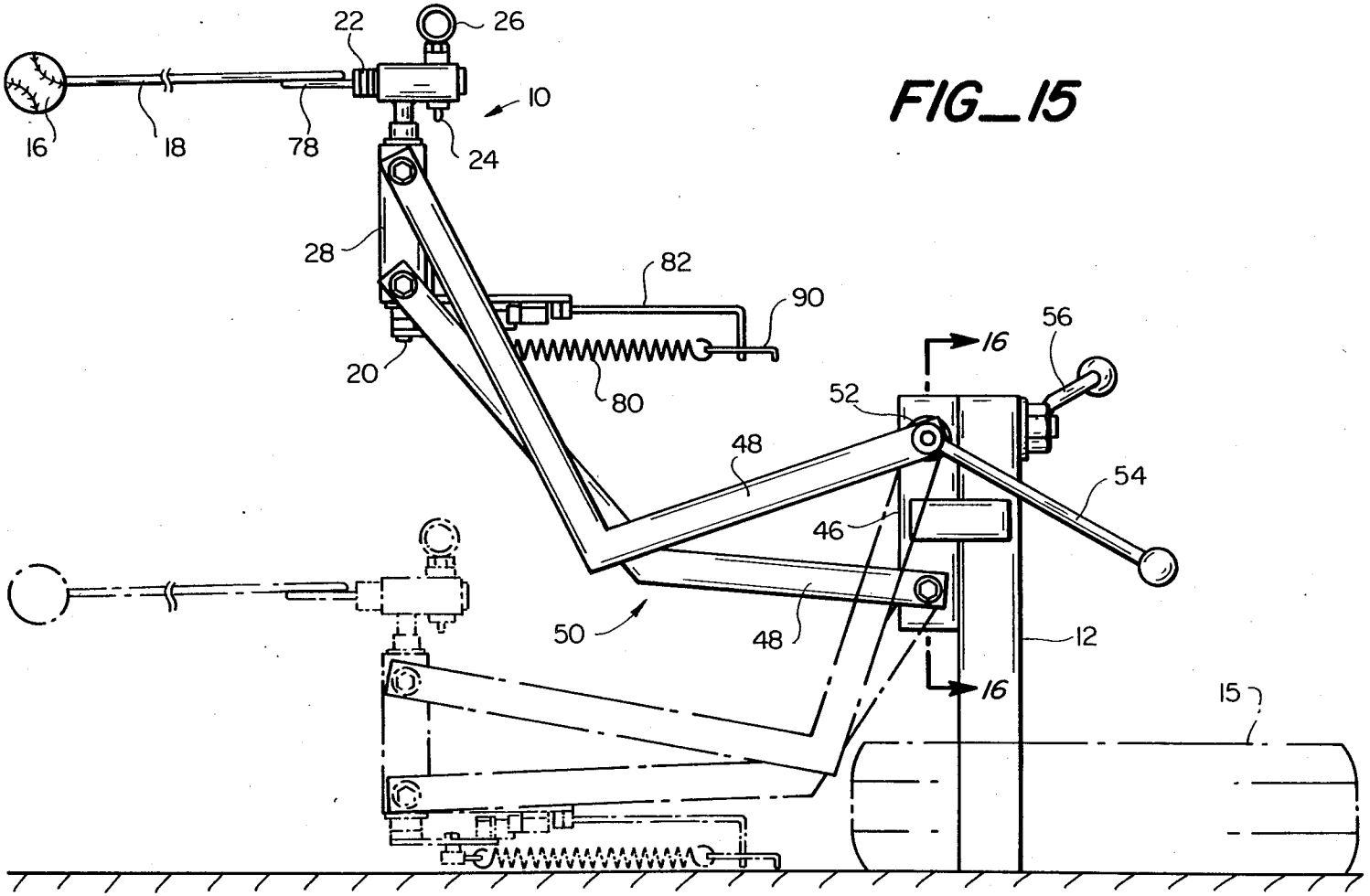
FIG. 15 is an alternative means for adjusting the height of the arm.
Figure 16:
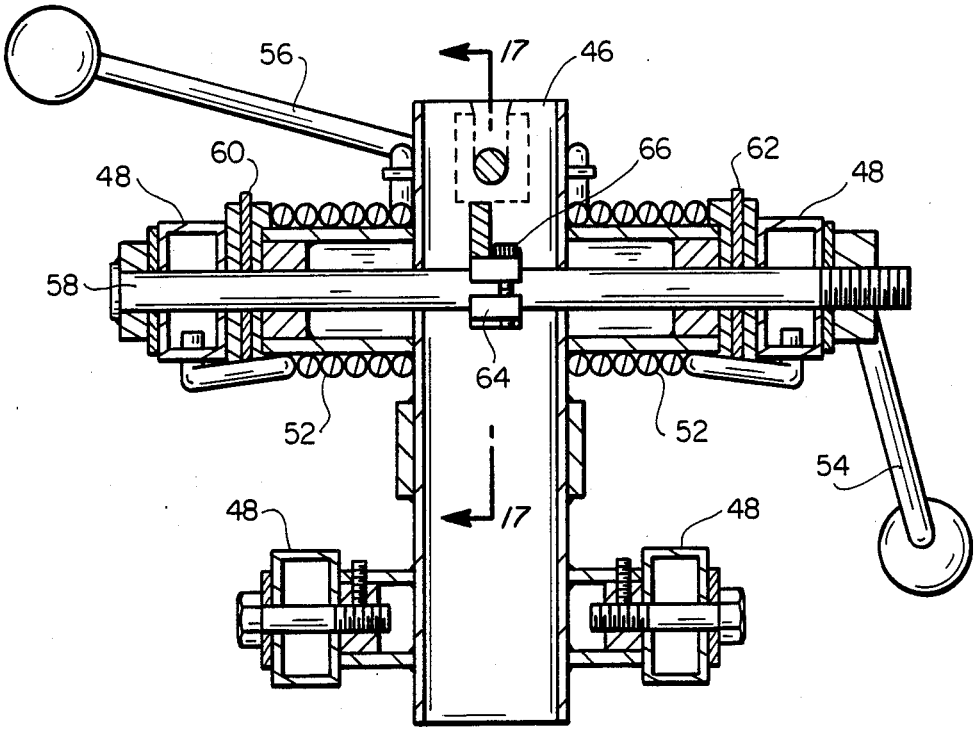
FIG. 16 is a sectional view taken through lines 16—16 of FIG. 15.
Figure 17:
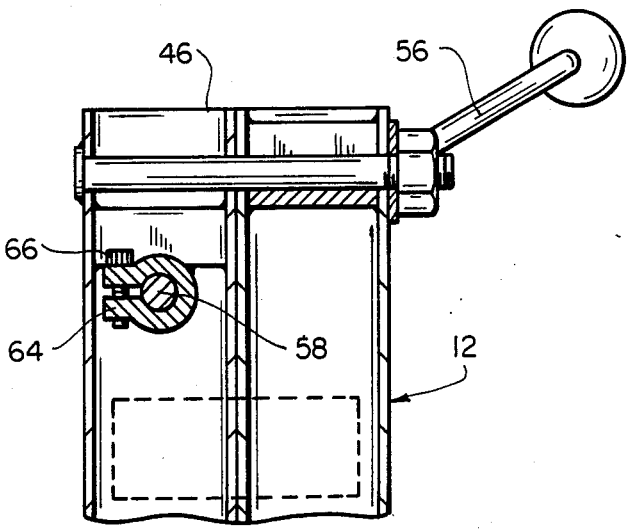
FIG. 17 is a sectional view taken through lines 17—17 of FIG. 16.

Another approach to adjusting the height of the arm 18 is depicted in FIG. 15–17, wherein the arms 48 of a pantograph 50 are connected to a rear support 46 of the post 12 at one end, and at the other end to the rotatable assembly 10 to which the arm is mounted. The angled pantograph arms 48 are hinged to pivot around a torsion spring 52 in reference to a height adjusting lever 54, which is attached to the rear support 46. As the adjusting lever is raised or lowered, the pantograph moves accurately and acts to raise or lower the post 10 of the rotatable assembly together with the arm 18 and ball 16. As the tension is released at thrust bearings 60 and 62, the pantograph arms are free to revolve to the selected height setting. A clamp device 64 retains the shaft 58, a locking nut 66 and locking lever 56 in the same radial position, so that at all positions of the adjust ball height, a fixed radial locking position exists.

When the locking lever 56 is in the release position, the adjusting lever 54 is rotated about a threaded portion of a main shaft 58. Once the desired height is set, the locking lever 56 is secured so that the adjusting lever 54 and associated pantograph arms are fixed in place.

Figure 2:
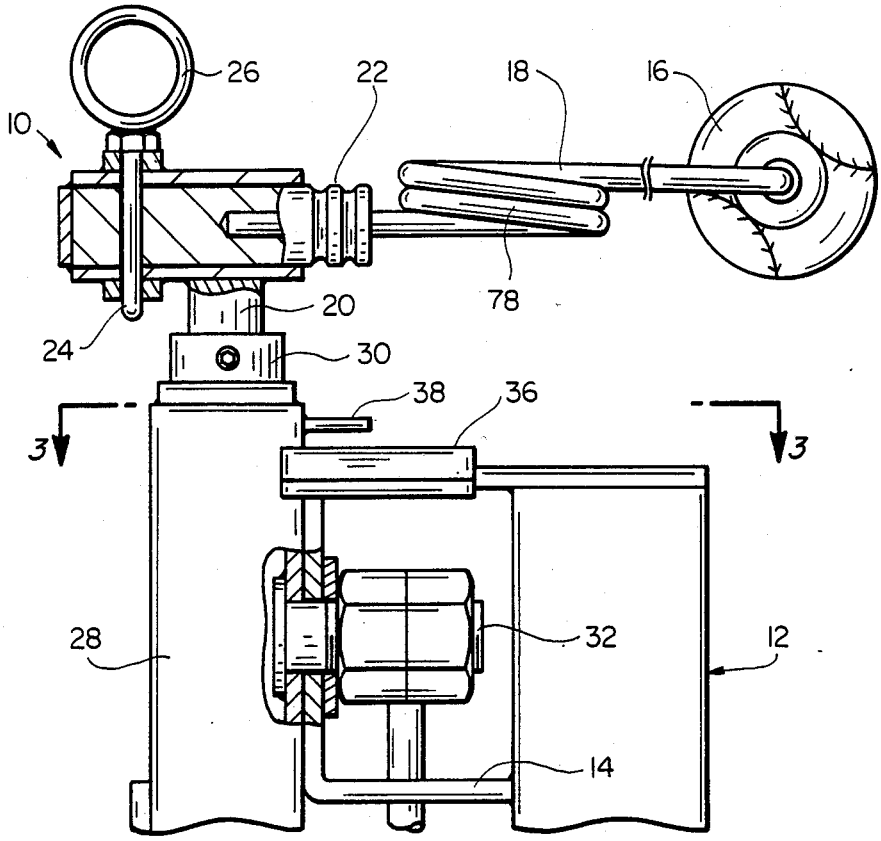
FIG. 2 is a side view, partly broken away, illustrating the ball and rotatable mounting arm.
Figure 3:
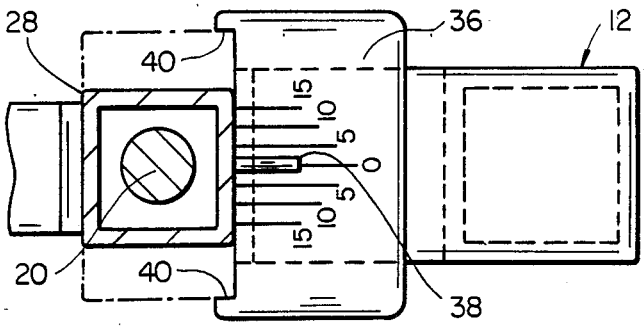
FIG. 3 is a section taken through lines 3—3 of FIG. 2.

FIGS. 2, 7 and primarily 9 depict a means for securing the ball 16 to the arm 18 so that the ball is not subject to separation from the arm after multiple impacts from a bat. In prior art devices, a sawtooth design was employed with a core sleeve swaged into a shaft groove to hold the ball. It was noted that a sharp sawtooth component caused rapid shearing of the ball material and reaming of a hole in the ball, thus resulting in loosening or decoupling of the ball from the arm.

In accordance with another feature of this invention, a plastic practice ball 16 which has a hole formed therein, engages a ball sleeve 112 that is attached to the arm 18, as illustrated in FIG. 9. The sleeve is preferably made of cold rolled steel, and is formed with radial grooves 108 machined or turned into the sleeve. Positive double keys 76 are pressed into a recess formed by a narrow diameter portion of the arm, diametrically opposed to each other, and welded in place. A space between the recess and the keys allows a slight lateral movement and primarily rotational motion of the ball upon impact. The ball rotation provides a true responsive action when struck by the bat. Upon impact by the bat, a thrust force is applied axially along the arm 18 which is countered by a concave thrust washer 110 welded to the sleeve 112. In this manner, the ball is attached to the arm assembly for maximum safety, so that the ball will not be loosened and fly from the end of the arm during batting practice.

The various features of this invention lend themselves to a batting practice device that will enhance the batting skill of professional baseball players as well as amateur players. The arm to which the ball is mounted can be tilted to the angle, relative to the horizontal plane, which accommodates the downward swing of the batter. Simple and expedient height adjustments are provided which can be effectuated rapidly by one person. Secure locking means are provided to maintain the shaft and arm in a fixed position. The braking and alignment device ensures that the arm and ball will return and settle in the rest or home position quickly and with accurate alignment. In addition, the ball is secured to the rotatable arm so that it will not separate after multiple impacts.

What is claimed is:

1. A training device for a baseball batter comprising:
a substantially vertical fixed post;
an elongated pivotable assembly;
means for pivotably connecting said pivotable assembly to said post so that it's longitudinal axis can be pivoted from a position parallel to the axis of said post to a position inclined at an acute angle with respect to the axis of said post, adjusting means cooperating between said connecting means and said pivotable assembly for setting the angle of inclination;
a rotatable arm mounted at one end to said pivotable assembly for rotation about said longitudinal axis of said pivotable assembly; and
a practice ball attached to the other end of said arm whereby when said ball is struck by a batter the arm and ball rotate in a plane perpendicular to the longitudinal axis of said pivotable assembly and at a complementary angle to the angle of the longitudinal axis of the pivotable assembly with respect to the axis of said post.

2. A training device as in claim 1, wherein said pivotable assembly includes a pivotable shaft to which said arm is mounted for rotation.

3. A training device as in claim 1, further including means for setting the height of said arm and ball relative to ground level.

4. A training device as in claim 3, including a securing lever for locking said height setting means so that said rotatable arm maintains the set height.

5. A training device as in claim 1, including means for positioning said rotatable arm for a left-hand batter or right-hand batter wherein said positioning means comprises a removable pin for allowing swinging said arm substantially 180° to accommodate left-hand or right-hand batters.

6. A training device as in claim 1 in which said means for setting the angle of inclination includes a calibration device for indicating the angle of inclination of, said pivotable assembly with respect to the longitudinal axis of the axis of said fixed post.

7. A training device for a baseball batter comprising:
a substantially vertical fixed post;
a pivotable assembly coupled to said post;
a rotatable arm mounted at one end to said pivotable assembly for rotation about an axis through said pivotable assembly;
a practice ball attached rotatably to the other end of said arm;
means for adjusting the angle of inclination of said pivotable assembly relative to the axis of said fixed vertical post whereby the arm and ball rotate in an angular plane;
means for rapidly braking the rotation of said arm and ball; and
means for aligning said arm to a true home position after each impact on the ball.

8. A training device as in claim 7, wherein said braking means comprises a snubber brake element and a swivel stop bar mounted to a crank plate.

9. A training device as in claim 7, wherein said aligning means comprises a torsion spring and a fixed apertured grip plate for engaging said torsion spring, so that said rotatable arm is precisely repositioned in a true alignment home position after rotation of said arm has ended.

10. A training device for a baseball batter comprising:
a substantially vertical fixed post;
a pivotable assembly coupled to said post;
a rotatable arm mounted at one end to said pivotable assembly for rotation about an axis through said pivotable assembly;
a practice ball attached rotatably to the other end of said arm;
means for adjusting the angle of inclination of said pivotable assembly relative to the axis of said fixed vertical post whereby the arm and ball rotate in an angular plane; and
means for setting the height of said arm and ball relative to ground level comprising a slotted external tube, an inner slidable tube, and an angled buffer element positioned between said tubes.

11. A training device as in claim 10, including a set screw that bears against said angled buffer element so that said inner slidable tube is compressed and the frictional pressure area between said outer and inner tubes is substantially increased to secure said adjusting means at a desired height setting.

12. A training device for a baseball batter comprising:
a substantially vertical fixed post;
a pivotable assembly coupled to said post;

a rotatable arm mounted at one end to said pivotable assembly for rotation about an axis through said pivotable assembly;

a practice ball attached rotatably to the other end of said arm;

means for adjusting the angle of inclination of said pivotable assembly relative to the axis of said fixed vertical post whereby the arm and ball rotate in an angular plane; and means for setting the height of said arm and ball relative to ground level comprising a pantograph structure with a plurality of pivotable hinged arms.

13. A training device for a baseball batter comprising:

a substantially vertical fixed post;

a pivotable assembly coupled to said post;

a rotatable arm mounted at one end to said pivotable assembly for rotation about an axis through said pivotable assembly;

a practice ball attached rotatably to the other end of said arm;

means for adjusting the angle of inclination of said pivotable assembly relative to the axis of said fixed vertical post whereby the arm and ball rotate in an angular plane; and a calibration device for indicating the angle of inclination of said pivotable assembly with respect to the fixed post comprising spaced grooves, each groove corresponding to an angle of tilt, and a spring lever coupled to said pivotable assembly for seating within a selected groove.

* * * * *